US010119282B2

(12) United States Patent
Rosati

(10) Patent No.: US 10,119,282 B2
(45) Date of Patent: Nov. 6, 2018

(54) ADAPTER FOR A FORMWORK SUPPORT STRUCTURE

(71) Applicant: FORM 700 PTY LTD, Altona, Victoria (AU)

(72) Inventor: Emilio Rosati, Altona (AU)

(73) Assignee: Form 700 Pty Ltd, Altona, Victoria (AU)

( * ) Notice: Subject to any disclaimer, the term of this patent is extended or adjusted under 35 U.S.C. 154(b) by 0 days.

(21) Appl. No.: 15/123,362

(22) PCT Filed: Mar. 3, 2015

(86) PCT No.: PCT/AU2015/000117

§ 371 (c)(1),
(2) Date: Sep. 2, 2016

(87) PCT Pub. No.: WO2015/131229

PCT Pub. Date: Sep. 11, 2015

(65) Prior Publication Data

US 2017/0067263 A1 Mar. 9, 2017

(30) Foreign Application Priority Data

Mar. 4, 2014 (AU) ..... 2014900721

(51) Int. Cl.
*E04G 11/48* (2006.01)
*E04G 25/00* (2006.01)
(Continued)

(52) U.S. Cl.
CPC ..... *E04G 11/483* (2013.01); *E04G 11/50* (2013.01); *E04G 17/04* (2013.01); *E04G 2025/006* (2013.01); *E21D 15/55* (2013.01)

(58) Field of Classification Search
CPC . E21D 15/55; E04G 2025/006; E04G 11/483; E04G 11/486; E04G 11/48; E04G 11/50; E04B 1/4114; E04B 2001/2415; E04B 2001/2421; E04B 2001/2644; E04B 2001/266
(Continued)

(56) References Cited

U.S. PATENT DOCUMENTS 607,867 A * 7/1898 Marshall ..... B61D 3/08 105/408
813,253 A * 2/1906 Sullivan ..... E04G 11/12 249/27
(Continued)

FOREIGN PATENT DOCUMENTS

DE 19636091 A1 3/1998
GB 741730 12/1955
(Continued)

*Primary Examiner* — Michael Safavi
(74) *Attorney, Agent, or Firm* — Christensen O'Connor Johnson Kindness PLLD

(57) ABSTRACT

The present invention relates to an adapter for a formwork support structure comprising a formwork support of a first type, the adapter comprising a mount for positioning the adapter with respect to said formwork support of a first type, said mount supporting a formwork support of a second type. In one form, the mount positions the adapter with respect to a crown type formwork support, and the mount supports a bearer support portion.

9 Claims, 5 Drawing Sheets

(51) Int. Cl.
*E04G 11/50* (2006.01)
*E04G 17/04* (2006.01)
*E21D 15/55* (2006.01)

(58) Field of Classification Search
USPC ..... 248/357; 254/100, DIG. 4; 249/18; 52/93.1, 93.2, 712, 713, 714, 715
See application file for complete search history.

(56) References Cited

U.S. PATENT DOCUMENTS 813,318 A * 2/1906 McCarthy ..... B66F 3/08 232/39
999,908 A * 8/1911 Tatro ..... A01G 17/10 248/354.1
1,258,409 A * 3/1918 Hill ..... E04B 1/19 248/357
1,490,461 A * 4/1924 Garlinghouse ..... E04G 11/483 248/357
1,612,516 A * 12/1926 Lampert ..... E04B 1/2604 248/357
1,612,517 A * 12/1926 Lampert ..... E04G 25/00 248/357
1,660,496 A * 2/1928 Symons ..... E04G 25/00 248/357
1,746,027 A * 2/1930 Cannon ..... E04G 21/32 182/113
2,331,247 A * 10/1943 Symons ..... E04G 25/04 248/357
3,001,754 A * 9/1961 Fowler ..... A47F 5/06 211/105.3
3,132,833 A * 5/1964 McLaughlin ..... B66F 3/24 248/357
3,203,660 A * 8/1965 Bowden ..... E04G 25/04 248/357
3,656,269 A * 4/1972 Witschel ..... E04G 1/14 182/178.1
3,915,423 A * 10/1975 Tooley ..... E04G 11/486 248/351
4,036,466 A * 7/1977 Van Meter ..... E04G 11/38 182/182.4
4,614,070 A * 9/1986 Idland ..... E04H 12/2253 52/295
4,741,505 A * 5/1988 Anderson ..... E04G 1/20 248/354.3
5,031,724 A * 7/1991 Quinn ..... E04G 25/06 182/186.6
5,520,360 A * 5/1996 Wensman ..... F16M 11/046 248/188.5
6,189,854 B1 * 2/2001 Irurzun Saez De Maturana ..... E04C 3/07 249/18
6,832,746 B2 * 12/2004 McCracken ..... E04G 11/483 248/357
8,262,056 B2 * 9/2012 Schwoerer ..... E04G 11/483 248/357
8,308,126 B2 * 11/2012 Arocena Begareche ..... E04G 11/38 249/18
8,430,374 B2 * 4/2013 Kurth ..... E04G 11/483 248/357
2004/0075042 A1 * 4/2004 Arozena Bergaretxe ..... E04G 11/486 249/210
2009/0194665 A1 * 8/2009 Martin ..... B28B 7/0014 249/18
2010/0193663 A1 8/2010 Kurth
2014/0263941 A1 * 9/2014 Zhang ..... E04G 11/38 249/18

FOREIGN PATENT DOCUMENTS

GB 741730 A 12/1955
WO 2013139102 A1 9/2013

* cited by examiner

ADAPTER FOR A FORMWORK SUPPORT STRUCTURE

CROSS REFERENCE TO RELATED APPLICATIONS

The present application is a National Stage Application claiming the priority of co-pending PCT Application No. PCT/AU2015/000117, filed Mar. 3, 2015, which in turn, claims priority from Australian Application No. 2014900721, filed Mar. 4, 2014. Applicant claims the benefits of 35 U.S.C. § 120 as to the PCT application and priority under 35 U.S.C. § 119 as to the said Australian application, and the entire disclosures of both applications are incorporated herein by reference in their entireties.

INCORPORATION BY REFERENCE

The following co-pending patent application is referred to in the following description:

PCT/AU2013/000855 titled "FORMWORK SUPPORT ELEMENT" and filed on 2 Aug. 2013 claiming priority from Australian Provisional Patent Application No 2012903312.

The content of this application is hereby incorporated by reference in its entirety.

TECHNICAL FIELD

The present invention relates to concrete formwork. In a particular form the present invention relates to an adapter for concrete formwork support structure.

BACKGROUND

During the construction of buildings, formwork is used in concrete construction to provide a mould or a surface onto which wet concrete can be poured for forming of features such as floor slabs and beams for example. In the case of floor slabs, it is common for floors of a multi-story building to be formed sequentially and for formwork to be set out on a preceding floor in order to form the subsequent higher floor.

Generally, a frame or scaffold is used to support elevated forms comprising either lost (i.e. not reusable) formwork, or a formwork that can be removed from the concrete slab once the concrete is set, and be reused. Reusable formwork may comprise aluminium formwork pans which are supported at the top of the scaffolding. Alternatively, sheets or boards supported on bearers may be used at the top of the framework.

The aluminium formwork pans are normally rectangular in plan form and have lips or edges extending downwardly from the formwork surface. These aluminium pans can be supported via 'crowns'-forks positioned atop scaffold uprights or props, and comprising four upwardly directed fingers extending from a single vertical support, each of which support a corner of four adjoining aluminium pans. These crowns are ill equipped to support anything other than these aluminium formwork pans.

It is against this background and the problems and difficulties associated therewith that the present invention has been developed.

Certain objects and advantages of the present invention will become apparent from the following description, taken in connection with the accompanying drawings, wherein, by way of illustration and example, an embodiment of the present invention is disclosed.

SUMMARY

According to a first aspect, there is provided an adapter for a formwork support structure comprising a formwork support of a first type, the adapter comprising a mount for positioning the adapter with respect to said formwork support of a first type, said mount supporting a formwork support of a second type.

In one form, one or both formwork supports is a female support. That is to say, they are or have a recessed part into which a corresponding part of the formwork (or a bearer) fits.

In one form, one or both of the formwork supports is a male support. That is to say, they are or have a part which is made to fit into a corresponding open or recessed part of the formwork (or a bearer).

In one form, the formwork support of a first type is adapted to provide direct support of formwork, and formwork panels in particular.

In one form, the formwork support of a first type is one which comprises a plurality of upwardly directed fingers extending from a single vertical support, and referred to as a crown.

In one form, the mount is adapted to nest between the fingers of the crown.

In one form, the formwork support of a second type is adapted to provide indirect support of formwork. In one form, the formwork support of a second type is adapted to provide support for bearers. In one form, the formwork support of a second type is so adapted by way of being shaped to nest a bearer.

In one form, the formwork support of a second type comprises a base, and a plurality of upwardly extending bearer guides.

In one form, the formwork support of a second type comprises an approximately u-shaped support.

In one form, the mount comprises a securement means for securing the adapter with respect to the formwork support of a first type. This securement means may comprise any one or more of fasteners, clamps (including quick release clamps), pins (including spring loaded pins), or threaded connection, but should not be considered limited to these.

In one form, the formwork support of a first type is adapted to cooperate with the mount of the adapter to at least effect stability of a positioning of the mount relative to the formwork support of a first type. The formwork support of a first type may be so adapted by being shaped to nest the mount, and/or comprising features (such as, but not limited to, lugs, pins or shoulders) to locate the mount.

In one form, the formwork support of a first type is further adapted to cooperate with the mount of the adapter to effect securement of the mount relative to the formwork support of a first type. The formwork support of a first type may be so adapted by being shaped and/or comprising features which cooperate with the securement means.

According to a second aspect, there is provided an adapter for a formwork support structure comprising a mount for positioning the adapter with respect to a crown type formwork support, said mount supporting a bearer support.

According to a third aspect, there is provided a framework bearer support bracket comprising a mount portion for positioning the bearer support bracket with respect to a formwork support, said mount supporting a bearer support potion.

According to a fourth aspect, there is provided a formwork support assembly comprising a formwork support of a first type, and an adapter comprising a mount for positioning the adapter with respect to said formwork support of a first type, said mount supporting a formwork support of a second type.

In one form, the formwork support of a first type and the adapter are operatively associated so as to effect stability of a positioning of the mount relative to the formwork support of a first type at least.

In yet a further aspect there is provided a formwork support which is adapted to effect stability of a positioning of a mount of an adapter relative to the formwork support, where said mount supports a formwork support of another type.

In yet a further aspect there is provided an adapter for a bearer support, the adapter comprising a mount for positioning the adapter with respect to the bearer support, said mount supporting a crown.

In a further aspect, there is provided an adapter for a formwork support structure, the adapter comprising a generally box shaped mount comprising a pair of side walls and a pair of end walls which are longer than, and extend lower than, the side walls, wherein the mount attaches the adapter to a formwork panel support comprising a plurality of upwardly directed fingers extending from a single vertical member, each of the end walls flanking opposing sides of the formwork panel support to nest the mount between the fingers of the formwork panel support, and the mount further comprising a securement means on each end wall to secure the adapter to the formwork panel support, and the mount further comprising a beam support atop of the mount.

In a further aspect, there is provided a beam support bracket comprising a generally box shaped mount comprising a pair of side walls and a pair of end walls which are longer than, and extend lower than, the side walls, wherein the mount attaches the bracket to a formwork panel support comprising a plurality of upwardly directed fingers extending from a single vertical member, each of the end walls flanking opposing sides of the formwork panel support to nest the mount between the fingers of the formwork panel support, and the mount further comprising a securement means on each end wall to secure the adapter to the formwork panel support, and the mount further comprising a beam support atop of the mount.

In a further aspect, there is provided a formwork support assembly comprising a formwork panel support comprising a plurality of upwardly directed fingers extending from a single vertical member, an adapter comprising a mount adapted for positioning the adapter on the formwork panel support, the adapter further comprising a support atop of the mount, which is adapted to support a beam, the formwork support assembly further comprising a beam supported on the support of the adapter.

A detailed description of one or more embodiments of the invention is provided below along with accompanying figures and photographs that illustrate by way of example the principals of the invention. While the invention is described in connection with such embodiments, it should be understood that the invention is not limited to any particular embodiment. On the contrary, the scope of the invention is limited only by the appended claims and the invention encompasses numerous alternatives, modifications and equivalents. For the purpose of example, numerous specific details are set forth in the following description in order to provide a thorough understanding of the present invention.

The present invention may be practiced according to the claim without some or all of the specific details. For the purpose of clarity, technical material is known in technical fields related to the invention has not been described in detail so that the present invention is not unnecessarily obscured.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Figure 1:
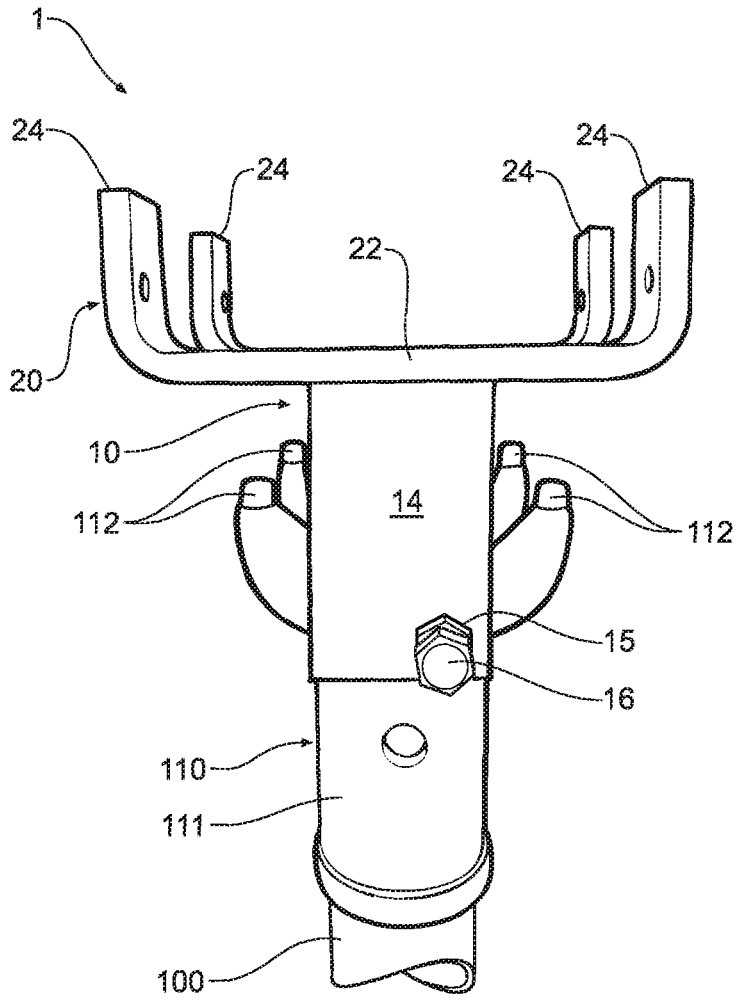
FIG. 1 is a perspective side view of an adapter mounted on a formwork support of a first type (a crown in this case)
Figure 2:
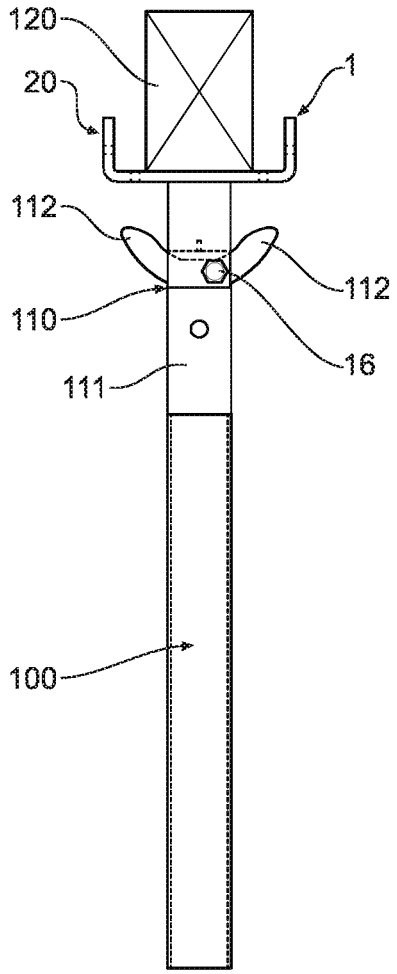
FIG. 2 is a side view of the adapter of FIG. 1 in use, supporting a bearer.
Figure 3:
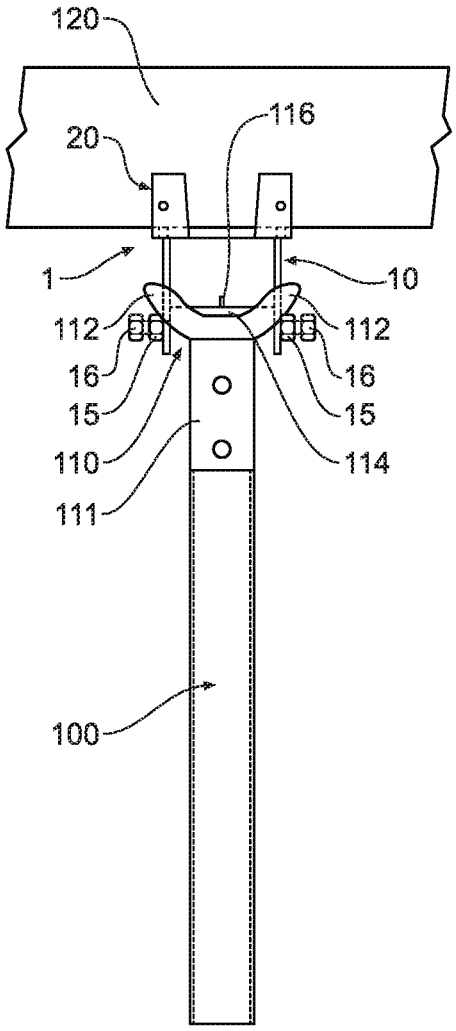
FIG. 3 is an end view of the adapter of FIG. 1 in use, supporting a bearer.
Figure 4:
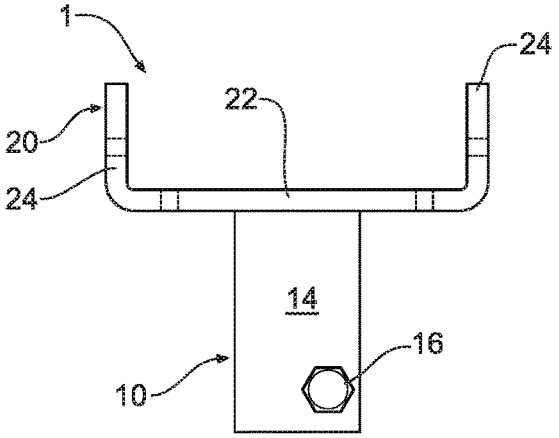
FIG. 4 is a side view of the adapter in isolation.
Figure 5:
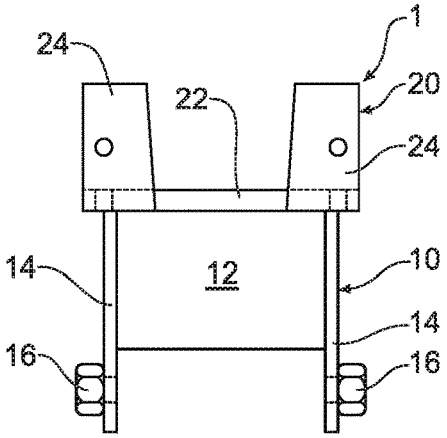
FIG. 5 is an end view of the adapter of FIG. 4.
Figure 6:
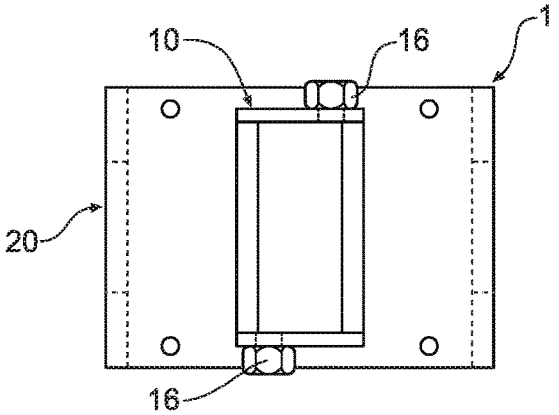
FIG. 6 is an underside view of the adapter of FIG. 4.
Figure 7:
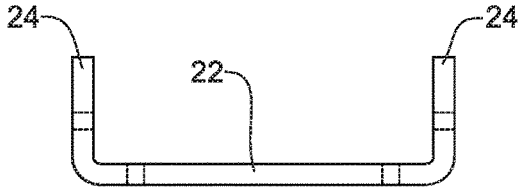
FIG. 7 is a side view of a support (for bearers) of the adapter of FIG. 4, in isolation.
Figure 8:
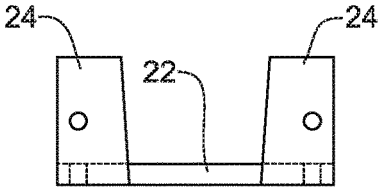
FIG. 8 is an end view of the support of FIG. 7.
Figure 9:
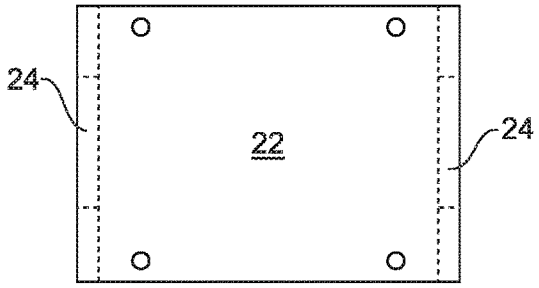
FIG. 9 is an underside view of the support of FIG. 7.
Figure 10:
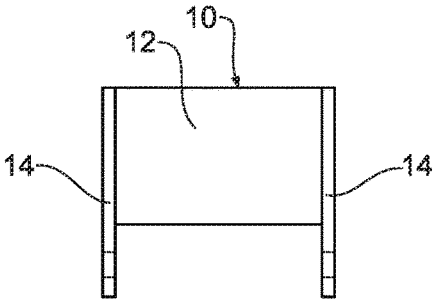
FIG. 10 is an end view of a mount of the adapter of FIG. 4, in isolation.
Figure 11:
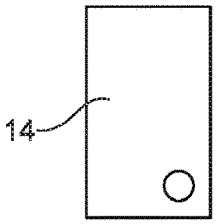
FIGS. 11 and 12 are side views of the mount of FIG. 10.
Figure 12:
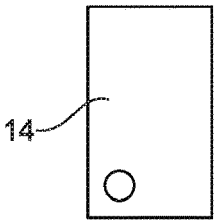
Figure 13:
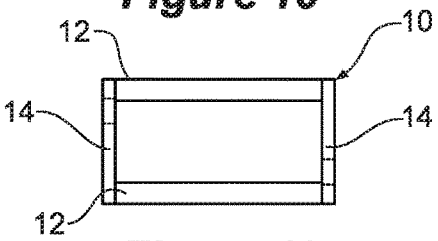
FIG. 13 is a top view of the mount of FIG. 10.

Referring now to FIGS. 1 through 3, where there is illustrated an upper portion of an upright or 'prop' 100 of a scaffold structure of the type discussed in PCT/AU2013/000855.

At its uppermost terminal end, the prop 100 supports a crown 110, where this crown 110 is a forked element comprising a neck 111 and four upwardly directed fingers 112. When used as intended, each finger 112 supports a corner of a formwork panel (not shown). Moreover, the crown 110 is typically supported on a screw jack (not shown) atop the prop 100 so that the crown 110 can be raised or lowered relative to the prop 100.

Crowns 110 are not well suited for supporting bearers (typically a timber beam) 120, which in use support formwork sheets (not illustrated). In this case, an adapter 1 can be employed.

With reference to FIGS. 1 through 5, it can be seen that adapter 1 comprises a mount 10, and a support 20.

Figure 14:
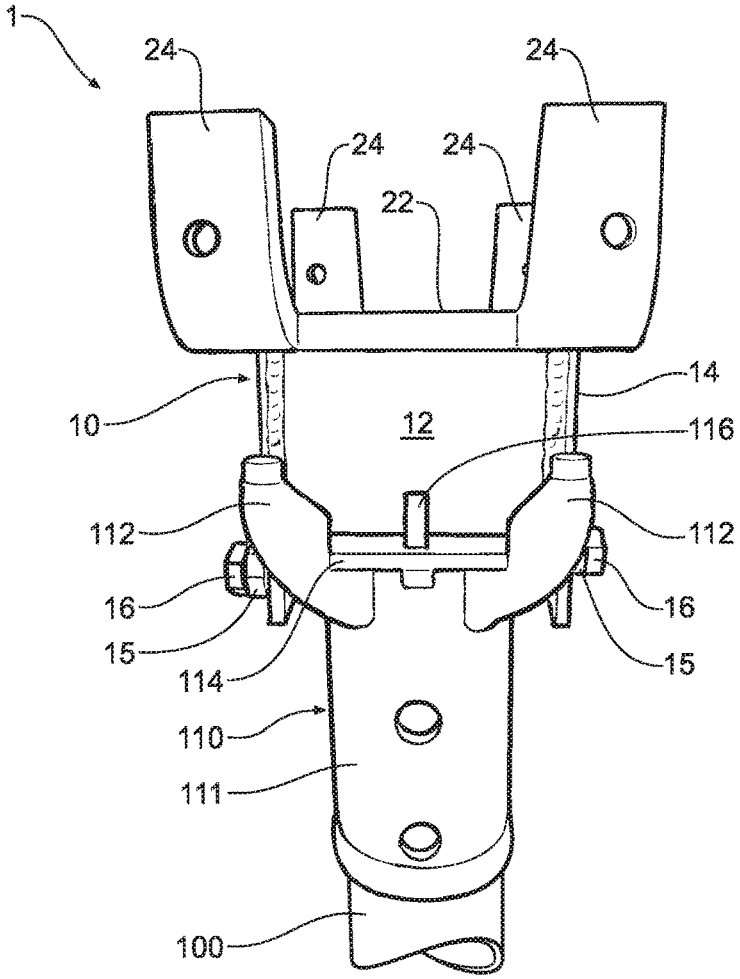
FIG. 14 is a perspective side view of the adapter and formwork support of FIG. 1.

In the embodiment illustrated, the mount 10 is adapted to mount the adapter 1 to a crown 110. Accordingly, the mount 10 is generally box shaped, and so comprises a pair of side walls 12 and a pair of end walls 14. Referring now to FIG. 14, the mount 10 rests upon a platform 114 provided by the crown 110, and is sized to securely nest between the fingers 112 and guide lugs 116 of the crown 110. The end walls 14 are longer than, and extend lower than, the side walls 12 and on either side of the neck 111 to a level beneath the fingers 112 of the crown 100. Each end wall 14 comprises a nut 15 carrying a bolt 16 which is screwed into the nut 15 to secure the adapter 1 on the crown 100 by driving an end of a shank of the bolt 16 into contact with the neck of the crown 100.

Supported atop of the mount 10 is a support 20 in the form of a support bracket comprising a base plate 22 and four (4)

upwardly extending bearer guides 24 arranged into two pairs of opposing bearer guides 24.

In use, the mount 10 of the adapter 1 is positioned on the platform 114 between the fingers 112 and guide lugs 116 of the crown 110 as described above, and the bolts 16 tightened. A bearer 120 can then be positioned on base plate 22 of the support bracket and between the bearer guides 24, which will serve to prevent the bearer 120 from sliding off of the base plate 22. Sheets of formwork (typically plywood sheets) can then be supported on the bearers 120.

When formwork panels (without bearers) are to be supported on the props 100, the bolts 16 will be loosened until the adapter 1 can be removed from the crown 110.

In the embodiment illustrated the crown 110 is a cast component and the adapter 1 is fabricated, but these parts are not restricted to manufacture in this way.

In an alternate embodiment, an adapter may have a reverse configuration to that described above, namely comprising a mount adapted to be positioned with respect to either of a bearer or a bearer support, and a crown for supporting a plurality of formwork panels.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. An adapter for a formwork support structure, the adapter comprising a generally box shaped mount comprising a pair of side walls and a pair of end walls which are longer than, and extend lower than, the side walls, wherein the mount attaches the adapter to a formwork panel support comprising a plurality of upwardly directed fingers extending from a single vertical member, each of the end walls flanking opposing sides of the formwork panel support to nest the mount between the fingers of the formwork panel support, and the mount further comprising a securement means on each end wall to secure the adapter to the formwork panel support, and the mount further comprising a beam support atop of the mount.

2. The adapter of claim 1, wherein the beam support is u-shaped.

3. The adapter of claim 1, wherein the beam support comprises a base, and a plurality of upwardly extending beam guides.

4. The adapter of claim 3, where the base extends outward from, and so is wider than the mount.

5. The adapter of claim 1, wherein the securement means on each end wall comprises a nut for receiving a bolt, which in use, is screwed into the nut to secure the adapter on the formwork panel support.

6. The adapter of claim 1, wherein at least one side wall engages with a guide lug of the formwork panel support.

7. A beam support bracket comprising a generally box shaped mount comprising a pair of side walls and a pair of end walls which are longer than, and extend lower than, the side walls, wherein the mount attaches the bracket to a formwork panel support comprising a plurality of upwardly directed fingers extending from a single vertical member, each of the end walls flanking opposing sides of the formwork panel support to nest the mount between the fingers of the formwork panel support, and the mount further comprising a securement means on each end wall to secure the adapter to the formwork panel support, and the mount further comprising a beam support atop of the mount.

8. The adapter of claim 7, wherein the securement means on each end wall comprises a nut for receiving a bolt, which in use, is screwed into the nut to secure the adapter on the formwork panel support.

9. The adapter of claim 7, wherein at least one side wall engages with a guide lug of the formwork panel support.

* * * * *